US006662454B2

(12) United States Patent
Harrold

(10) Patent No.: US 6,662,454 B2
(45) Date of Patent: Dec. 16, 2003

(54) CHILD RESISTANT, DISPOSABLE, PREMEASURED DOSAGE SPOON

(75) Inventor: John E. Harrold, Bloomsbury Borough, NJ (US)

(73) Assignee: Valley Design, Inc., Bloomsbury, NJ (US)

( * ) Notice: Subject to any disclaimer, the term of this patent is extended or adjusted under 35 U.S.C. 154(b) by 170 days.

(21) Appl. No.: 09/955,277

(22) Filed: Sep. 18, 2001

(65) Prior Publication Data

US 2003/0051350 A1 Mar. 20, 2003

(51) Int. Cl.[7] ..... A61J 7/00

(52) U.S. Cl. ..... 30/326; 206/223; 220/326; 220/831; 220/839

(58) Field of Search ..... 220/326, 839, 220/846, 831; 30/326, 141; 206/572, 223, 541; 215/DIG. 5

(56) References Cited

U.S. PATENT DOCUMENTS

| | | | | | |
|---|---|---|---|---|---|
| 1,474,443 | A | | 11/1923 | Rhyne | |
| 1,708,456 | A | * | 4/1929 | Tunick | 30/326 |
| 3,911,578 | A | * | 10/1975 | Ushkow et al. | 30/326 |
| 4,574,944 | A | * | 3/1986 | Gregory | 206/5.1 |
| 4,724,615 | A | | 2/1988 | Mackles et al. | |
| 5,121,834 | A | * | 6/1992 | Tissembaum | 206/38.1 |
| 5,740,940 | A | * | 4/1998 | Weiss | 220/592.25 |
| 5,975,305 | A | | 11/1999 | Barger | |
| 5,988,459 | A | | 11/1999 | Nelson et al. | |
| 5,992,667 | A | * | 11/1999 | Huang | 220/212 |
| 6,089,392 | A | * | 7/2000 | Daoud | 220/4.02 |
| 6,092,690 | A | * | 7/2000 | Bitowft et al. | 220/831 |
| 6,283,298 | B1 | * | 9/2001 | Seidler | 206/581 |

* cited by examiner

*Primary Examiner*—Timothy V. Eley
*Assistant Examiner*—John Windmuller
(74) *Attorney, Agent, or Firm*—Kenneth P. Glynn, Esq.

(57) ABSTRACT

The present invention relates to a child resistant, disposable, premeasured dosage spoon. It includes a bowl portion having a premeasured dosage volume bowl, a front end for oral insertion, a back end. It also includes a handle portion having a front end and a back end, wherein the back end is hingedly connected to the back end of the bowl portion and folds over onto said bowl portion to reduce the overall length of the spoon. There is also a child resistant mechanism having a male segment and a female segment adapted to interlock with one another, and adapted to require at least a two step movement for release of interlock with one another. One of the male segment and the female segment is located on the front of said bowl portion and the other of said male segment and said female segment being located on said front of said bowl portion and the other is located on the front end of the handle portion so as to enable them to interlock when the handle portion is folded over onto the bowl portion. There is a seal and pull tab in some preferred embodiments.

16 Claims, 3 Drawing Sheets

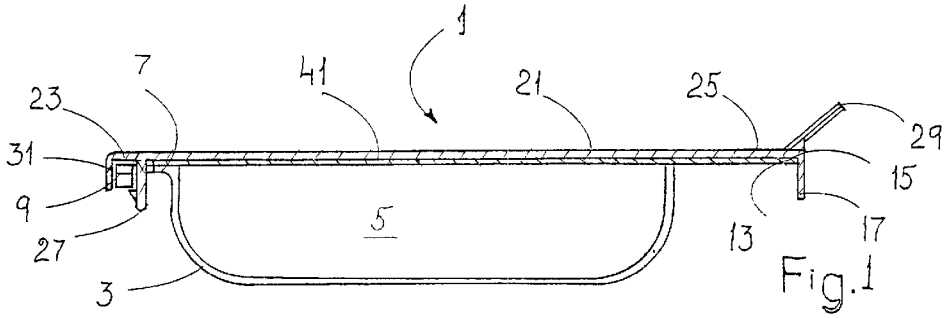
Fig.1
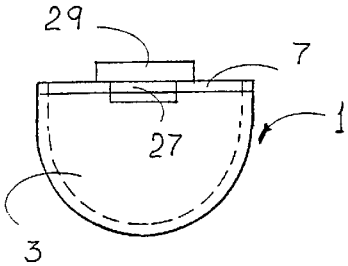
Fig.2
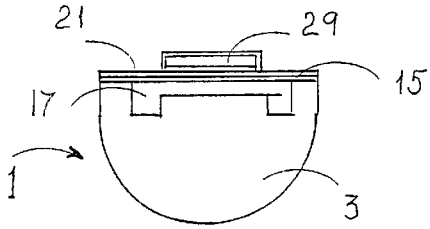
Fig.3
Fig.4
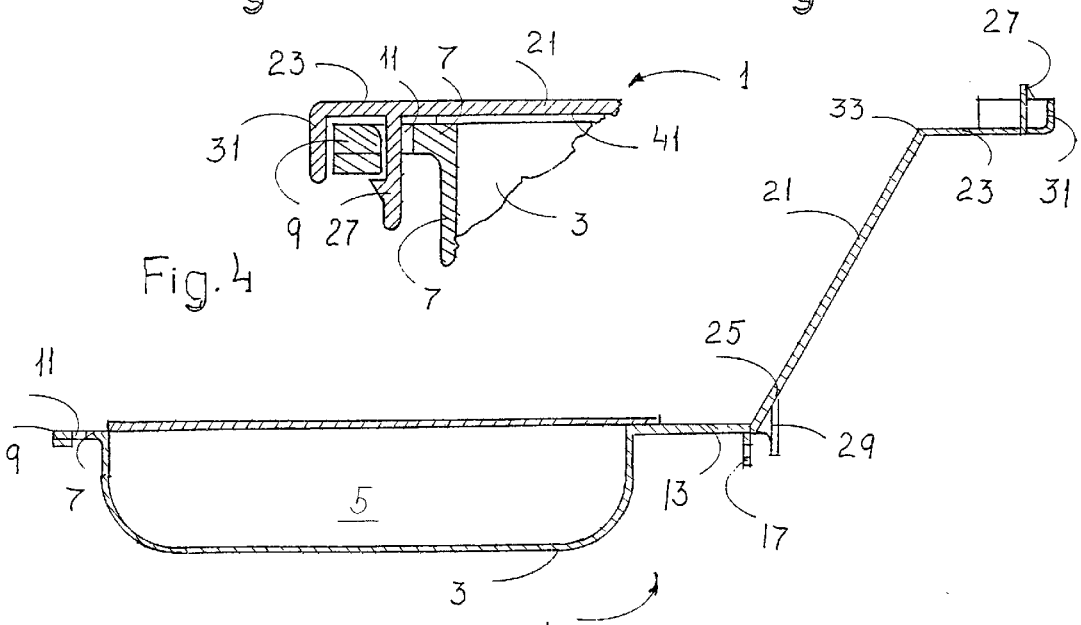
Fig.5

CHILD RESISTANT, DISPOSABLE, PREMEASURED DOSAGE SPOON

BACKGROUND OF THE INVENTION

1. Field of the Invention

The present invention relates to metering medicine dosages and particularly to the need for supplying users with premeasured dosage packaging. More particularly, the present invention relates to child resistant premeasured packaging which will be convenient and efficient yet difficult for children to breach. Specifically, the present invention involves a child resistant, disposable, premeasured dosage spoon useful for liquid, powder, bead, slurry or other flowable medicine.

2. Information Disclosure Statement

The following patents relate to the state of the art in the field of disposable spoons for metered dosage medicine:

U.S. Pat. No. 5,988,459 to Nelson et al. describes a child-resistant package including a multilayered polymeric tray having a basin and a brim. The tray has a plastic structural layer and a bonding layer. A multilayered polymeric cover has a cross-oriented, tear-resistant layer, a bonding layer, and a moisture-barrier layer between the tear-resistant layer and the bonding layer of the cover. The bonding layer of the cover is sealed to the bonding layer of the brim of the tray to form a closed cavity between the tray and the cover.

U.S. Pat. No. 5,975,305 to Steven J. Barger describes a unit dose spoon having a bowl portion, a recessed handle portion communicating with the bowl portion. An upwardly extending pedestal is mounted in the recessed handle portion and is provided with an upwardly extending cutting blade on the top surface thereof. A container is integrally hinged to the free end of the handle portion and contains a unit dose of fluid such as medicine, which is sealed in the container by a rupturable plastic cover. When the container is folded forwardly toward the handle portion and pushed downwardly toward the pedestal, the blade thereon punctures the plastic cover to allow fluid to flow from the container into the recessed handle portion and into the bowl portion. The unit dose spoon is formed of molded plastic and is disposable.

U.S. Pat. No. 4,724,615 to Mackles et al. describes a medicine spoon having a spoon bowl with a handle, and a flat cover completely covering the bowl in a closed position in which the cover bears against the edge of the bowl. The cover has a handle attached to the bowl handle for pivotal movement between the closed and open positions, and the cover has an opening through which an amount of a foam product from a dispenser may be fed to the bowl in the closed position of the cover. The underside of the cover scrapes along the upper edge of the bowl for wiping the underside clean during movement of the cover to its open position. Stop shoulders in the form of continuous flanges are provided on the bowl and cover for both limiting the cover to its completely closed position and for preventing leakage of product through the cover when filling.

U.S. Pat. No. 1,474,443 to Robert B. Rhyne describes in a medicine spoon, the combination with a bowl portion and a handle therefor; of a cover for the bowl thereof and having an angularly disposed handle, the angular juncture of the cover and its handle being engaged with the handle of the spoon to form a fulcrum, and said handle of the cover being arranged in space relation to the spoon handle and adapted to be moved toward the spoon handle to cause said angular juncture to fulcrum and move the cover away from the bowl of the spoon.

Notwithstanding the prior art, the present invention is neither taught nor rendered obvious thereby.

SUMMARY OF THE INVENTION

The present invention child resistant, disposable, premeasured dosage spoon, includes:

(a.) a bowl portion having a premeasured dosage volume bowl and having a front end for oral insertion with said bowl, and having a back end;

(b.) a handle portion having a front end and a back end, wherein said back end is hingedly connected to said back end of said bowl portion; and, (c.) a child resistant mechanism having a male segment and a female segment adapted to interlock with one another. The child resistant mechanism is adapted to require at least a two step movement for release of interlock with one another. One of the male segment and the female segment may be located on the front end of the bowl portion and the other of the male segment and the female segment being located on the front end of the handle portion. For example, the male segment may be located on the handle portion and the female segment on the bowl portion, or vice versa. Optionally, but preferred is the present invention spoon which further includes a removable seal panel extending over and sealing the bowl, especially with a pull tab for removal of the seal panel from the spoon.

In some preferred embodiments, the child resistant mechanism male segment includes a living spring tongue with a ratchet protrusion, and the female segment includes a slot adapted to receive the tongue, wherein the ratchet protrusion locks onto an underside of the front on which the slot is located, requiring a push back and lift up two step movement for opening.

In other preferred embodiments, the child resistant male segment includes a living spring "C" shaped catch with a ratchet protrusion at its base and the female segment includes an underside ledge for receiving and interlocking the male segment, requiring a pull down, pull out and lift up movement for opening.

BRIEF DESCRIPTION OF THE DRAWINGS

The present invention should be more fully understood when the specification herein is taken in conjunction with the drawings appended hereto wherein:

FIGS. 1, 2 and 3 show a side cut view, a front view and a rear view of one embodiment of the present invention child resistant, disposable, premeasured dosage spoon;

FIG. 4 shows a partial blown up cut view with details of the child resistant interlocking mechanism of the present invention spoon shown in FIGS. 1, 2 and 3;

FIGS. 5, 6 and 7 show a side cut view of the present invention spoon of FIG. 1 with the handle portion partially open, a top view with the handle portion fully open and a side view of the handle portion fully open, respectively;

DETAILED DESCRIPTION OF THE PRESENT INVENTION

Figure 6:
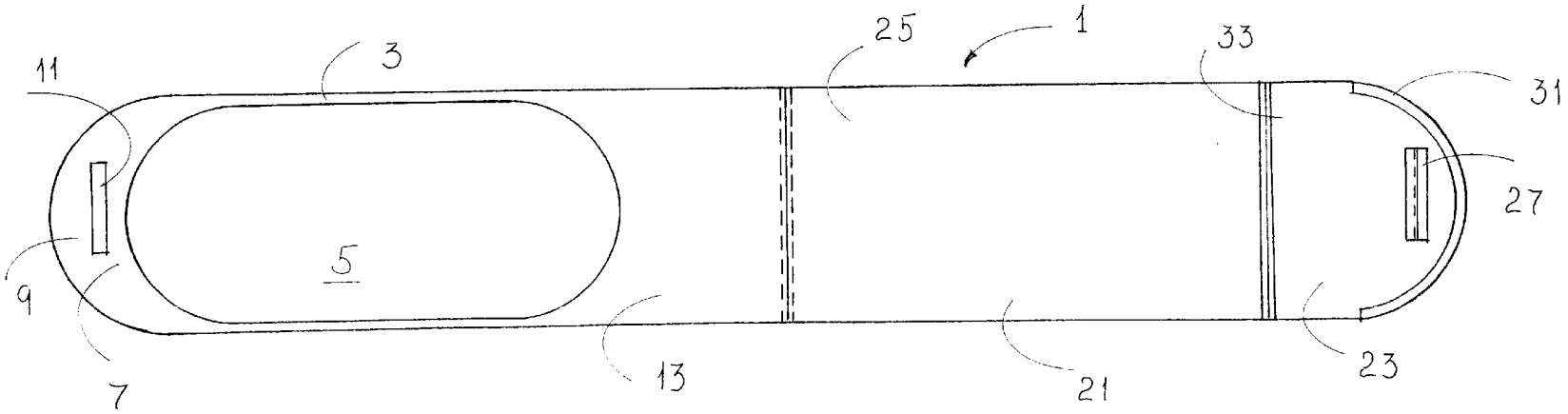

Referring now to FIGS. 1, 2 and 3, there is shown a present invention child resistant, disposable, premeasured dosage spoon 1 in its side cut view, respectively. All of the elements shown in these Figures, as well as FIGS. 4, 5, 6 and 7 have identical parts identically numbered.

Spoon 1 includes a bowl portion 3 with a front end 7 and a back end 13 as well as a handle portion 21 with front end 23 and back end 25. Bowl portion 3 includes a premeasured dosage volume bowl 5 and its back end 13 is hingedly connected to back end 25 of handle portion 41 at unistructurally molded thin area 15 which acts as a hinge. Also at the back end 13 of bowl portion 3 and back end 25 of handle portion 21 is a two component lock to maintain the spoon in a fully opened position. Thus, rigid insert member 29 on handle portion 21 fits into receiving member 17 on bowl portion 3 to create an approximately 180° angle between bowl portion 3 and handle portion 21 when in its fully opened position. Further, these members interlock to prevent collapse of the fully opened spoon to avoid spillage during use. (In the alternative, the insert member could be located on the bowl portion and the receiving member on the handle portion.) Bowl 15 would typically be used for a flowable medicine and would be sealed with a foil or other seal such as removable seal 41.

Referring now to FIGS. 1 through 3 and FIG. 4 front end 7 of bowl portion 3 and front end 23 of handle portion 21 includes a child resistant mechanism with a male segment located on the front end 23 of handle 21 and a female segment located on front end 7 on bowl portion 3. Thus, front end 23 has a rim 31 and a male segment 27 downwardly protruding with a locking ratchet, as shown in FIGS. 1 and 4. Front end 7 has a lip 9 with a slot 11, for receiving male segment 27. Male segment 27 is a tongue member with a living spring feature molded to be biased in the position shown in FIG. 4. Male segment 27 must be pushed in and then up in order to release the interlock and open handle portion 21.

Figure 7:
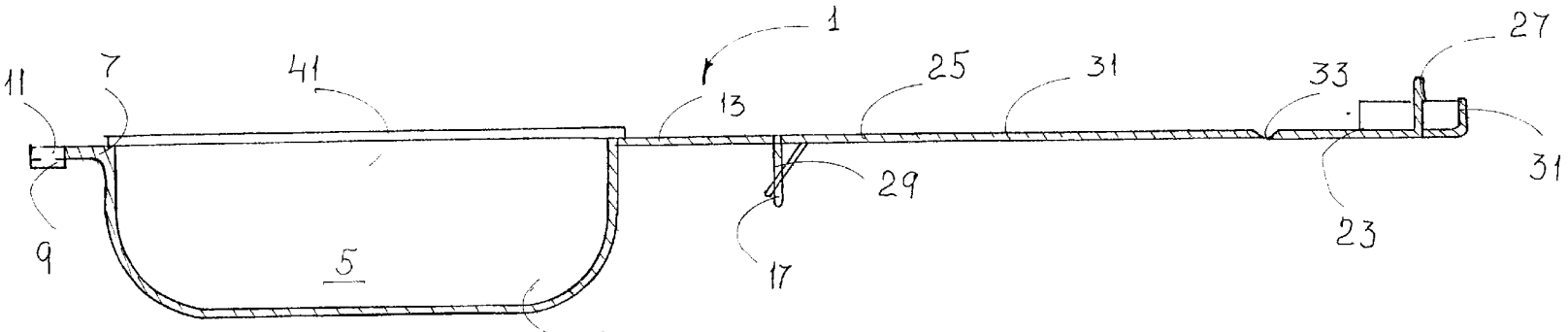

As shown in FIG. 5, handle 21 has been opened partially and as shown in FIGS. 6 and 7, has been fully opened with insert member 29 of handle portion 21 and receiving member 17 of bowl portion 3 interconnecting to establish a full length, rigged spoon. Foil 41 is removed prior to consumption of the premeasured medication which may be contained therein.

Figures 8, 9, 10:
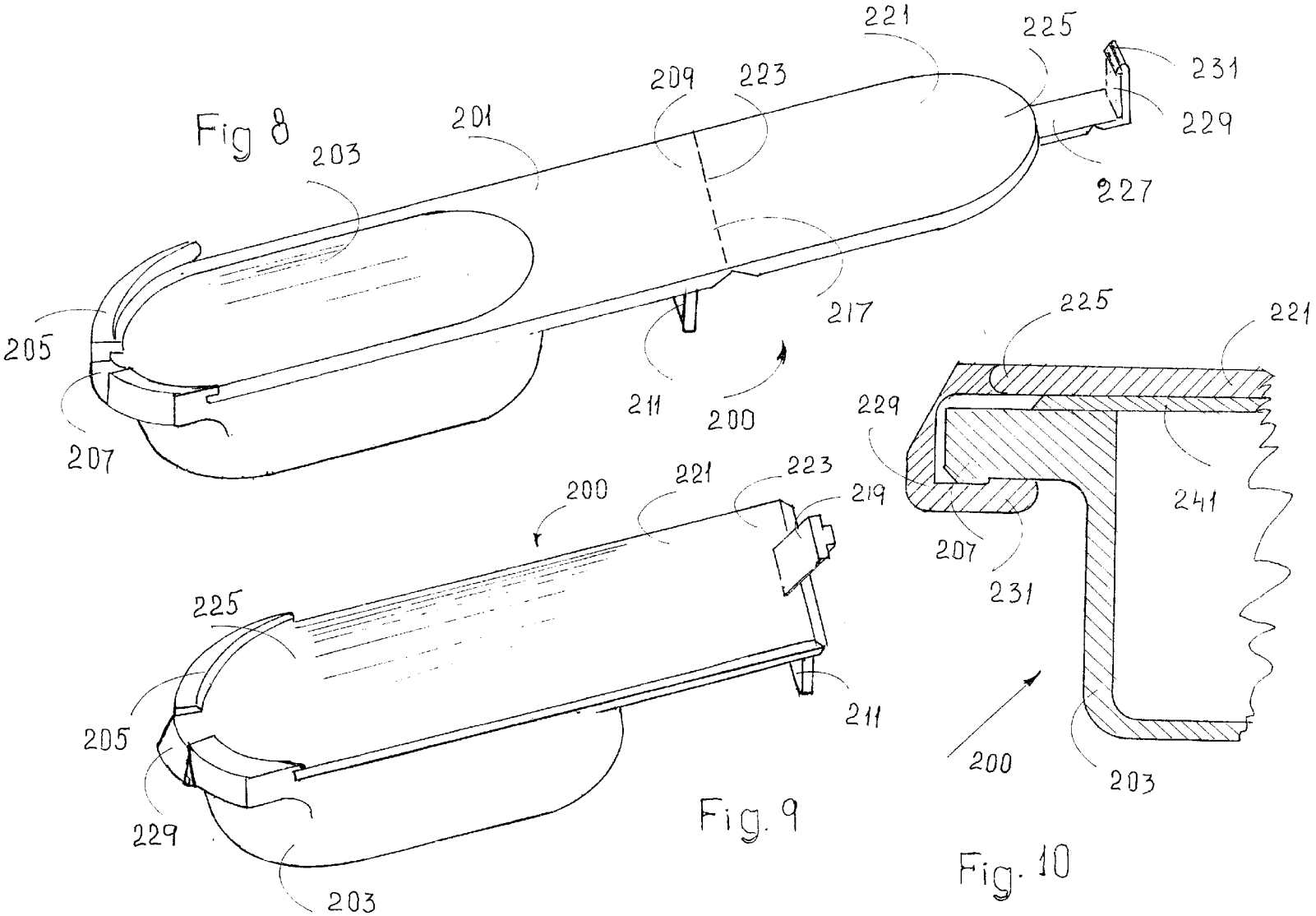
FIGS. 8 and 9 show perspective views of a child resistant, disposable, premeasured dosage present invention spoon in the opened and closed position, respectively.
FIG. 10 shows a partial cut side view of its child resistant safety mechanism.

FIGS. 8, 9 and 10 show another embodiment present invention child resistant, disposable, premeasured spoon in its open and closed perspective views and a side cut view, respectively. Identical parts are identically numbered. Present invention spoon 200 includes a bowl portion 201 with a front end 205 and a back end 209 hingedly connected to a handle portion 221 with front end 225 and back end 223. These are hingedly connected at thin area 217. As can be seen in FIG. 1, there is a receiving groove 207 in front end 205 for receiving male segment 227 of the child resistant mechanism located at back end 225 of handle portion 221. Receiving groove 207 has a protrusion on its underside and receiving groove 207 is adapted to receive male segment 227 and its protruding tongue 229 and ratchet 231. These are shown in detail in FIG. 10 and require a pull down, pull out, push and lift movement.

Obviously, numerous modifications and variations of the present invention are possible in light of the above teachings. It is therefore understood that within the scope of the appended claims, the invention may be practiced otherwise than as specifically described herein.

What is claimed is:

1. A child resistant, disposable, premeasured dosage spoon, which comprises:

(a.) a bowl portion having a premeasured dosage volume bowl and having a front end for oral insertion with said bowl, and having a back end;

(b.) a handle portion having a front end and a back end, wherein said back end is hingedly connected to said back end of said bowl portion; and, (c.) a child resistant mechanism having a male segment and a female segment adapted to interlock with one another, and adapted to require at least a two step movement for release of interlock with one another, one of said male segment and said female segment being located on said front end of said bowl portion and the other of said male segment and said female segment being located on said front end of said handle portion.

2. The child resistant, disposable, premeasured dosage spoon of claim 1 wherein said spoon further includes a removable seal panel extending over and sealing said bowl.

3. The child resistant, disposable, premeasured dosage spoon of claim 2 wherein said seal panel contains a pull tab for removal of said seal panel from said spoon.

4. The child resistant, disposable, premeasured dosage spoon of claim 1 wherein said child resistant mechanism male segment includes a living spring tongue with a ratchet protrusion, and said female segment includes a slot adapted to receive said tongue and wherein said ratchet protrusion locks onto an underside of the front end on which said slot is located, requiring a push back and lift up two step movement for opening.

5. The child resistant, disposable, premeasured dosage spoon of claim 4 wherein said male segment is located on said front end of said handle portion.

6. The child resistant, disposable, premeasured dosage spoon of claim 2 wherein said ratchet protrusion locks onto an underside of the front end on which said slot is located, requiring a push back and lift up two step movement for opening.

7. The child resistant, disposable, premeasured dosage spoon of claim 2 wherein said male segment is located on said front end of said handle portion.

8. The child resistant, disposable, premeasured dosage spoon of claim 1 wherein a two component lock is included to maintain said spoon in a fully opened position, said two component lock having an insert member and a receiving member, and one of said insert member and said receiving member is located on said bowl portion and the other is located on said handle portion.

9. A child resistant, disposable, premeasured dosage spoon, which comprises:

a single piece structure unistructurally formed of plastic, which includes:

(a.) a bowl portion having a premeasured dosage volume bowl and having a front end for oral insertion with said bowl, and having a back end;

(b.) a handle portion having a front end and a back end, wherein said back end is hingedly connected to said back end of said bowl portion; and, (c.) a child resistant mechanism having a male segment and a female segment adapted to interlock with one another, and adapted to require at least a two step movement for release of interlock with one another, one of said male segment and said female segment being located on said front end of said bowl portion and the other of said male segment and said female segment being located on said front end of said handle portion.

10. The child resistant, disposable, premeasured dosage spoon of claim 9 wherein said spoon further includes a removable seal panel extending over and sealing said bowl.

11. The child resistant, disposable, premeasured dosage spoon of claim 10 wherein said seal panel contains a pull tab for removal of said seal panel from said spoon.

12. The child resistant, disposable, premeasured dosage spoon of claim 9 wherein said child resistant mechanism male segment includes a living spring tongue with a ratchet protrusion, and said female segment includes a slot adapted to receive said tongue and wherein said ratchet protrusion locks onto an underside of the front on which said slot is located, requiring a push back and lift up two step movement for opening.

13. The child resistant, disposable, premeasured dosage spoon of claim 12 wherein said male segment is located on said front end of said handle portion.

14. The child resistant, disposable, premeasured dosage spoon of claim 10 wherein said ratchet protrusion locks onto an underside of the front on which said slot is located, requiring a push back and lift up two step movement for opening.

15. The child resistant, disposable, premeasured dosage spoon of claim 10 wherein said male segment is located on said front end of said handle portion.

16. The child resistant, disposable, premeasured dosage spoon of claim 9 herein a two component lock is included to maintain said spoon in a fully opened position, said two component lock having an insert number and a receiving member, and one of said insert member and said receiving member is located on said bowl portion and the other is located on said handle portion.

* * * * *